United States Patent [19]

Uetsuhara

[11] Patent Number: 4,752,757

[45] Date of Patent: Jun. 21, 1988

[54] ELECTROMAGNETIC ACTUATOR

[75] Inventor: Tokio Uetsuhara, Urawa, Japan

[73] Assignees: Mitsubishi Co., Ltd., Tokyo; Iwasaki Electronics, Ltd., Kyoto, both of Japan

[21] Appl. No.: 26,546

[22] PCT Filed: Jun. 4, 1985

[86] PCT No.: PCT/JP85/00313

§ 371 Date: Jan. 28, 1987

§ 102(e) Date: Jan. 28, 1987

[87] PCT Pub. No.: WO86/07490

PCT Pub. Date: Dec. 18, 1986

[51] Int. Cl.[4] ..... H01F 7/08

[52] U.S. Cl. ..... 335/230; 335/234

[58] Field of Search ..... 335/78, 79, 80, 81, 335/84, 229, 230, 234

[56] References Cited

U.S. PATENT DOCUMENTS

| | | | |
|---|---|---|---|
| 3,329,916 | 7/1967 | Carson | 335/230 |
| 4,020,433 | 4/1977 | Uchidoi et al. | 335/234 X |
| 4,142,166 | 2/1979 | Arnoux | 335/230 X |
| 4,160,222 | 7/1979 | Reuting | 335/78 X |
| 4,321,570 | 3/1982 | Tsunefuji | 335/234 |
| 4,533,890 | 8/1985 | Patel | 335/234 |

*Primary Examiner*—George Harris

*Attorney, Agent, or Firm*—Bierman and Muserlian

[57] ABSTRACT

According to the present invention, an electromagnetic actuator comprises a closed magnetic circuit consisting of a magnetic stationary member in a closed loop shape; an electric coil for energizing the closed magnetic circuit; and a movable member made of a permanent magnet, which member is bridgingly connected between a pair of restricted sections, facing each other, of the closed magnetic circuit through gaps so as to apply magnetomotive force to the closed magnetic circuit.

1 Claim, 3 Drawing Sheets

ELECTROMAGNETIC ACTUATOR

TECHNICAL FIELD

The present invention relates to an electromagnetic actuator such as an electromagnetic switch, electromagnetic valve, electromagnetic brake, electromagnetic clutch, and the like which have been broadly used in the industrial field and people's livelihood.

BACKGROUND TECHNIQUE OF THE PRESENT INVENTION

Conventional electromagnetic actuators have generally utilized the electromagnetic attractive force applied by a magnetic movable member as an electric energy is supplied to an electric coil wound around a magnetic stationary member. Further, another type of conventional electromagnetic actuator known as a latching type electromagnetic actuator uses the magnetomotive force caused by an electric coil as it is energized and the other magnetomotive force caused by a permanent magnet applied to a magnetic movable member in series thereto.

FIG. 4(*a*) and FIG. 4(*b*) are schematic structual illustrations for explaining a clapper type electromagnetic actuator which is a typical example of the above described former conventional devices. In the drawings, this type of actuator comprises a magnetic stationary member 3 having magnetic pole faces 3*a* and 3*b*, an electric coil 2, a magnetic movable member 4 and a spring 5.

FIG. 4(*a*) shows one condition in which the coil 2 is not energized. Under this condition, the movable member 4 is maintained in its stable state with keeping some space with respect to the magnetic pole faces 3*a* and 3*b* by means of the bias force in the direction represented by the arrow 7 caused by the spring 5. Under this condition, if the coil 2 is supplied with the current of predetermined value, electromagnetic attractive force greater than the bias force generated by the spring 5 is generated between the stationary member 3 and the movable member 4. The movable member 4 is changed into the state as shown in FIG. 4(*b*) in which the movable member 4 is attracted to the stationary member 3. According to this movement, an actuating linkage, not shown, such as an electric contact, valve rod, or the like is mechanically actuated. This actuator will return to the state shown in FIG. 4(*a*) when the electric coil 2 is free from the energizing current.

FIG. 5(*a*) and FIG. 5(*b*) are schematic structural illustrations explaining a latching type electromagnetic actuator which is the later conventional device described above. This latching type actuator comprises a pair of magnetic stationary members 3, 3 having respective magnetic pole faces 3*a*, 3*b*, an electric coil 2, a magnetic movable member 4, a permanent magnet 1 interposed between the stationary members 3, 3, and a spring 5.

In FIG. 5(*a*), when the coil 2 is not energized, the movable member 4 is kept in its stable state keeping the movable member 4 isolated from the magnetic pole faces 3*a* and 3*b* owing to the bias force in the direction represented by the arrow 7 originated by the spring 5. Under this condition, the electric coil 2 is supplied with the current to generate the magnetomotive force having the same polarity as that of the permanent magnet 1. Both magnetomotive forces are duplicated and this duplicated magnetomotive force generates a greater electromagnetic attractive force between the stationary member 3 and the movable member 4 greater than the bias force in the direction represented by the arrow 7 of the spring 5. Thus the movable member 4 is attracted to the stationary member 3 as shown in FIG. 5(*b*), so that an actuating linkage, not shown, such as an electric contact, valve rod, or the like is actuated.

Under this stable condition shown in FIG. 5(*b*), even if the coil 2 is free from the energized current, this condition is maintained owing to only the attractive force of the permanent magnet 1.

On the other hand, under the condition shown in FIG. 5(*b*), when the coil 2 is supplied with the current to generate the magnetomotive force having the counter polarity of the permanent magnet 1, the magnetomotive force of the permanent magnet 1 is cancelled by this counter force. Thus the movable member 4 is returned to its initial stable position shown in FIG. 5(*a*) by the cancellation and, the bias force originated by the spring 5. According to this manner, this type of actuator can achieve its latching operation.

However, the above described conventional electromagnetic actuators have some problems as follows.

(1) The value of ampere-turns required to energize the gap is too large. Particularly, the latching type actuator requires greater ampere-turns for energizing the coil since the permanent magnet having a great magnetic reluctance is arranged in series in the magnetic circuit which is energized as the coil is supplied with electric current.

(2) In the type in which the current for energizing the coil is continuously supplied to the actuator when the actuating force is generated, the energy consumption is too large in addition to the above condition (1).

(3) The above condition (1) causes the temperature of the electric coil to increase and makes its size larger.

(4) It is necessary to pay attention to treat for residual magnetic flux in case that DC electric magnet is used.

(5) The latching type electromagnetic actuator requires two electric coils for attracting and returning operations or a complicated actuating circuit since the value of ampere-turn required for attracting the movable member is different from that of returning operation.

DESCRIPTION OF THE INVENTION

With these problems in mind, it is an object of the present invention to provide an improved electromagnetic actuator which is highly sensitive, is controlled with a remarkably small electric power, and is small sized, simply constructed and tough.

The present invention is based on the following knowledge.

Magnetic flux owing to the magnetomotive force originated by a permanent magnet is represented by $\phi m$. The magnetic flux is divided into the left direction magnetic flux $\alpha \cdot \phi m$ and right direction magnetic flux $\beta \cdot \phi m$ in a stationary member 3, ($\alpha$, $\beta$ represent the ratio of divided flow and are smaller than 1.) Magnetic flux $\phi i$ is generated by an electric coil as the energizing current is applied thereto. Assuming that a proportional constant K is employed and leakage of magnetic flux is ignored in order to simplify, the attractive force F applied to a movable member by the energized electric coil can be represented by the following equation.

$$F = K(\beta \cdot \phi m + \phi i)^2 \quad (1)$$

Wherein, the relation between $\alpha$ and $\beta$ is represented by the equation $$\alpha+\beta=1.$$

The equation (1) is rearranged by substituting $$\phi m=\eta\cdot\phi i$$

($\eta$ represents a coefficient of magnet), and thus the rearranged equation is as follows.

$$F=K\cdot\phi i^2(\beta\cdot\eta+1)^2 \quad (2)$$

On the other hand, assuming that the magnetic flux $\phi$io is generated by an energized electric coil of a conventional electromagnetic actuator with the same proportional constant as the above actuator, the attractive force Fo applied to a movable member is represented by the following equation.

$$Fo=K\cdot\phi io^2 \quad (3)$$

According to the above equations (2) and (3), if $\phi$i is equivalent to $\phi$io; i.e., both actuators are actuated at the same value of ampere-turns, the relation between them is represented by the following equation.

$$Fo/F=(\beta\cdot\eta+1)^2 \quad (4)$$

If F is equivalent to Fo; i.e., the attractive force of the actuator according to the present invention is equal to that of the conventional actuator, the relation between them is represented by the following equation;

$$\phi i/\phi io=1/(\beta\cdot\eta+1) \quad (5)$$

As is clear from graphs in FIG. 2 and FIG. 3 which show the values of F/Fo and $\phi/\phi$io resulted from the equations (4) and (5) in which several values are substituted and $\beta$ are parameters, the actuator according to the present invention can easily generate an attractive force several times greater than that of the conventional actuator at the same value of ampere-turns and the equivalent attractive force at a smaller value of ampere-turns.

The electromagnetic actuator of the present invention can be accomplished according to the above described knowledge.

According to the present invention, the electromagnetic actuator comprises a magnetic stationary member in a closed loop shape, an electric coil for energizing a closed magnetic circuit consisting of the closed loop shape stationary member, and a movable member made of a permanent magnet, said member being bridgingly connected between a facing pair of restricted sections, of the closed magnetic circuit so that magnetomotive force is applied to the closed magnetic circuit. These actuators can generate great actuating force with an extremely small current.

The electromagnetic actuator according to the present invention constituted by the above description is characterized that the overall configuration and size of the actuator are in proportion to the required energizing ampere-turn and the required electric power is in proportion to the square of the required energizing ampere-turn, so that this actuator can provide the following excellent effects. Accordingly, this actuator is remarkably useful for various industrial usages and private usage.

(1) The actuator according to the present invention can generate much greater attractive force by the electric power having the same value of ampere-turns as the conventional device.

(2) The actuator according to the present invention can generate the equivalent attractive force by the electric power having extremely smaller value of ampere-turns as the conventional device.

(3) The actuator according to the present invention can execute various type electromagnet functions such as mono-stable, bi-stable, multi-stable and the like.

According to the above effects, the actuator of the present invention further provides following detailed features.

(a) This actuator of the present invention can easily actuate various devices by a small energy such as a solar battery, a dry cell, or the like.

(b) This actuator is highly sensitive and saves energy.

(c) This actuator is small and light.

(d) This actuator can be free from the effects of residual magnetism, so that its action can be certainly performed.

(e) This actuator is simply constructed and tough, so that it is suitable for mass-production.

THE BEST MODE FOR EMBODYING THE INVENTION

Hereinbelow, the present invention will be explained according to the embodiments in conjunction with the accompanying drawings.

Figure 1A:
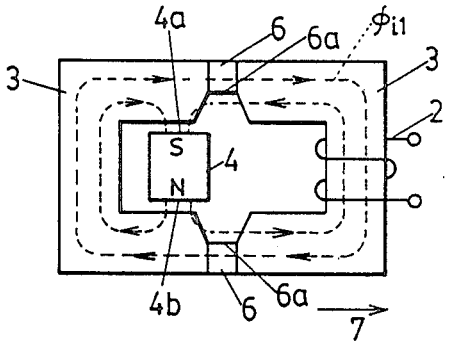
FIG. 1(*a*), FIG. 1(*b*) and FIG. 1(*c*) are schematic illustrations for explaining one embodiment according to the present invention.
Figure 1B:
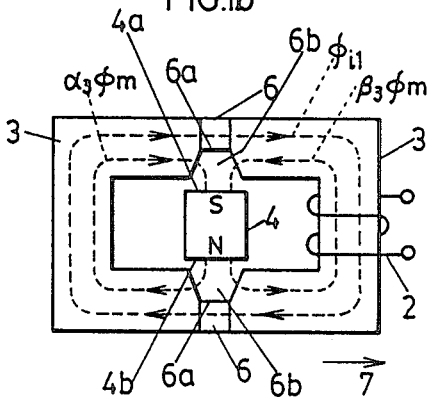
Figure 1C:
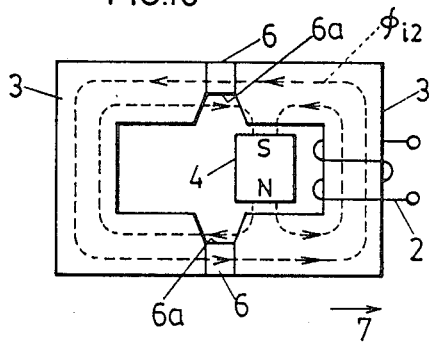
Figure 2:
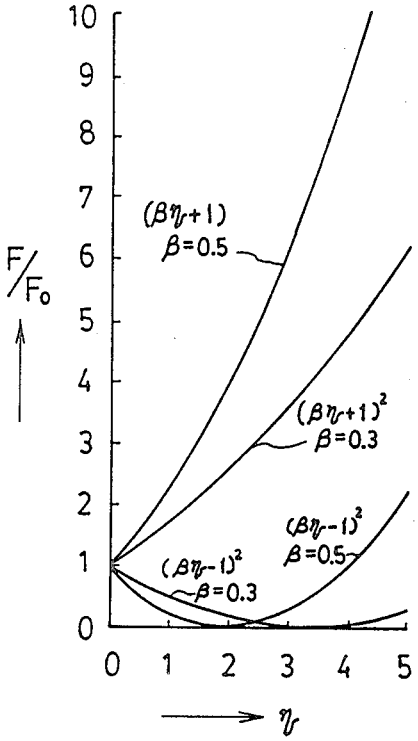
FIG. 2 and FIG. 3 are graphs for explaining characteristics of the electromagnetic actuator according to the present invention.
Figure 3:
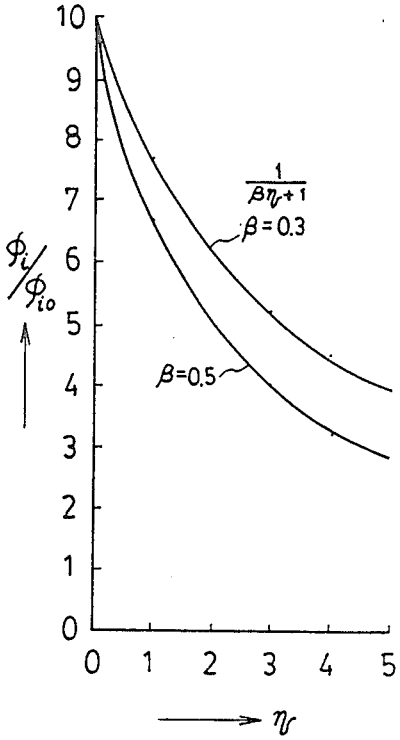
Figure 4A:
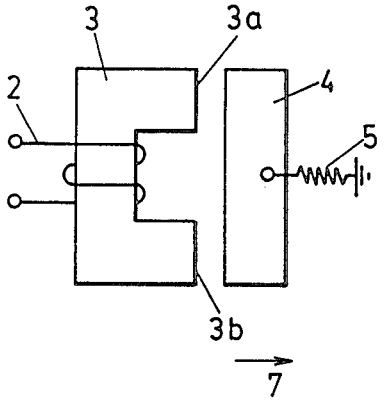
FIG. 4(*a*), FIG. 4(*b*) and FIG. 5(*a*), FIG. 5(*b*) are schematic illustrations for explaining conventional electromagnetic actuators.
Figure 4B:
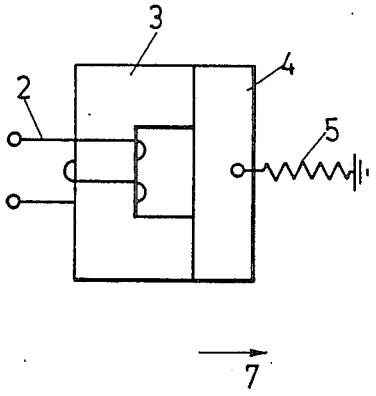
Figure 5A:
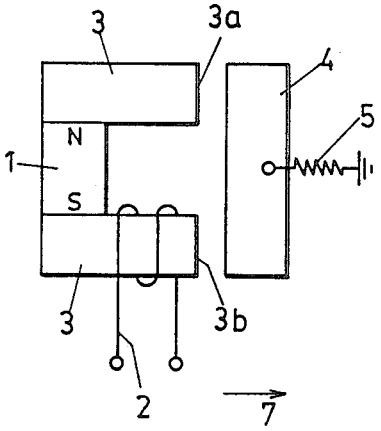
Figure 5B:
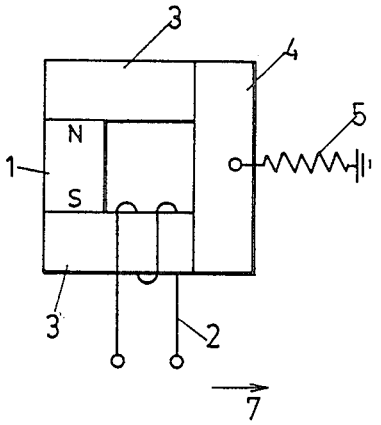

FIG. 1(*a*), FIG. 1(*b*) and FIG. 1(*c*) show one embodiment according to the present invention. In the drawings, a magnetic stationary member 3 is substantially formed in a closed loop shape so as to form a closed magnetic circuit. An electric coil 2 is wound around the stationary member 3 to energize the closed magnetic circuit. A movable member 4 consisting of a permanent magnet is movably arranged in the inner space of the closed circuit so that the movable member 4 can apply magnetomotive force to one pair of restricted sections facing each other through the movable member 4 and gaps. Further, the stationary member 3 is provided with a pair of saturable magnetic members 6 as magnetic flux adjusting elements which are facingly arranged to each other so as to perform the adjustment of the ratio of the magnetic flux distribution. The ratio of the distributed magnetic fluxes $\alpha$ and $\beta$ is an important factor in its function as explained in the knowledge previously described.

The movable member 4 consisting of the permanent magnet is so arranged that its magnetic faces 4*a* and 4*b* face side surfaces 6*a* of respective saturable magnetic member 6 fixed to the magnetic stationary member 3 through gaps so that the movable mamber 4 can be moved in the direction represented by the arrow 7 or the counter direction thereof. When the electric coil 2 is free from the energizing current, the movable member 4 is maintained in the position shown in FIG. 1(*b*) by the bias force of a spring not shown.

Under the condition shown in FIG. 1(*b*), as the electric coil 2 is supplied with a predetermined energizing current to generate the magnetic flux $\phi i_1$ having the polarity shown in the drawing, the magnetic fluxes $\phi i_1$, $\alpha_3 100$ m, and $\beta_3 \phi m$ are overlapped as explained in the knowledge previously described and thus the movable member 1 consisting of the permanent magnet is moved leftwards as shown in FIG. 1(*a*).

On the contrary, under the condition shown in FIG. 1(*b*), when the coil 2 is supplied with the current to generate the magnetic flux $\phi i_2$ having the reverse polarity shown in FIG. 1(*c*), the movable member 4 is moved rightwards as shown in FIG. 1(*c*).

After the movable member 4 has been shifted in the position shown in FIG. 1(*a*) or FIG. 1(*c*), the operation for self-holding the movable member 4 in the position shown in FIG. 1(*a*) or FIG. 1(*c*) or automatically returning it to the position shown in FIG. 1(*b*) can be freely selected by the control for supplying the energizing current to the electric coil 2.

POSSIBILITY FOR USE IN INDUSTRIAL FIELD

As given explanation above, the present invention is useful for various industrial usage and private usage such as electromagnetic actuating device, electromagnetic actuating piston, electromagnetic locking device, actuating mechanism for opening and closing, essential anti-explosion device, tripping mechanism for accident, or the like.

I claim:

1. An electromagnetic actuator comprising a stationary member, a movable member capable of reciprocally moving with respect to said stationary member, a coil wound around a magnetic circuit consisting of said stationary member and said movable member, said coil generating a first magnetic flux when said coil is energized, and a permanent magnet generating a second magnetic flux; the improvement characterized in that said stationary member is of a closed loop shape and has saturable magnetic members (6) for reluctance adjusting the magnetic reluctance thereof whereby said second magnetic flux generated by said permanent magnet is adjusted in order to increase attractive force and move the movable member and;

the second magnetic flux dividingly flows and is parallel to the first magnetic flux, said second magnetic flux being cancelled or overlapped with said first magnetic flux in order to move said movable member.

* * * * *